US009714517B2

(12) United States Patent
Rabon

(10) Patent No.: US 9,714,517 B2
(45) Date of Patent: Jul. 25, 2017

(54) HOT TUB COVER

(71) Applicant: Walter Rabon, Westminister, CO (US)

(72) Inventor: Walter Rabon, Westminister, CO (US)

( * ) Notice: Subject to any disclaimer, the term of this patent is extended or adjusted under 35 U.S.C. 154(b) by 331 days.

(21) Appl. No.: 14/336,936

(22) Filed: Jul. 21, 2014

(65) Prior Publication Data

US 2015/0020304 A1 Jan. 22, 2015

Related U.S. Application Data

(60) Provisional application No. 61/856,953, filed on Jul. 22, 2014.

(51) Int. Cl.

| | |
|---|---|
| ***E04H 4/00*** | (2006.01) |
| ***E04H 4/08*** | (2006.01) |
| *A61H 33/00* | (2006.01) |

(52) U.S. Cl.

CPC ..... *E04H 4/08* (2013.01); *A61H 33/0087* (2013.01); *A61H 33/6005* (2013.01)

(58) Field of Classification Search

CPC ..... E04H 4/08
USPC ..... 4/498
See application file for complete search history.

(56) References Cited

U.S. PATENT DOCUMENTS

| | | | | |
|---|---|---|---|---|
| 1,588,799 | A | 6/1926 | Nilson | |
| 3,258,441 | A * | 6/1966 | Beimler | C01B 33/146 427/387 |
| 4,078,293 | A | 3/1978 | Aine | |
| 4,422,192 | A | 12/1983 | Jacobs | |
| 4,857,374 | A | 8/1989 | Perry | |
| 5,373,590 | A | 12/1994 | Svae | |
| 5,566,403 | A * | 10/1996 | Black | E04H 4/084 220/264 |
| 5,950,252 | A * | 9/1999 | Fettes | E04H 4/084 4/498 |
| 6,996,860 | B1 | 2/2006 | Blake | |
| 8,251,832 | B2 * | 8/2012 | Henry | A63G 3/02 4/498 |
| 2005/0086731 | A1 * | 4/2005 | Scott | E04H 4/08 4/498 |
| 2008/0282461 | A1 * | 11/2008 | Sneed | E04H 4/08 4/498 |
| 2011/0088157 | A1 * | 4/2011 | Young | E04H 4/108 4/498 |
| 2012/0073039 | A1 * | 3/2012 | Hotaling | E04H 4/10 4/498 |

* cited by examiner

*Primary Examiner* — Christine Skubinna
(74) *Attorney, Agent, or Firm* — Quickpatents, LLC; Kevin Prince

(57) ABSTRACT

A cover for a hot tub comprises at least one deck that includes a rigid frame surrounded by a foam material covered on a top side and at side edges thereof with a layer of plywood coated with an elastomeric paint. A bottom side of each deck is covered with a first water impervious web. A skirt made from a second water impervious web is fixed proximate to at least one of the side edges of each deck and extends down to cover at least a portion of a peripheral wall of the hot tub when the cover is fixed over the hot tub. In one embodiment, a plurality of foam beams, each mutually separated and including a plurality of notches, convey heat from the hot tub through the deck to melt snow or ice formed on the top side of each deck.

9 Claims, 5 Drawing Sheets

HOT TUB COVER

CROSS-REFERENCE TO RELATED APPLICATIONS

This application claims the benefit of U.S. Provisional Patent Application 61/856,953, filed on Jul. 22, 2014, and incorporated herein by reference.

STATEMENT REGARDING FEDERALLY SPONSORED RESEARCH AND DEVELOPMENT

Not Applicable.

FIELD OF THE INVENTION

This invention relates to hot tubs, and more particularly to an improved hot tub cover.

DISCUSSION OF RELATED ART

Prior art hot tub covers suffer from exposure to outdoor elements and weather, and are not particularly durable. In cold weather climates, snow and ice piled onto the top of such covers results in bowing and eventual failure of the covers due to weight. Further, the cover, and are prone to damage by snow removal tools as well as the weight of the user. Such prior art covers tend to have slick materials on the top surfaces thereof, such as vinyl web materials, particularly when wet. As such, it is easy to slip when standing on such covers while removing ice therefrom.

U.S. Pat. No. 6,112,340 to Ziebert et al. on Sep. 5, 2000, teaches a spa cover having reinforced metal structural members. While such a product provides more strength than a traditional foam-covered-with-vinyl cover, such a product does not allow heat to escape therethrough sufficient to melt snow accumulation on the cover. Further, the exterior surface of the Ziebert device is an ABS-type plastic that, when wet, becomes relatively slippery and dangerous to walk on.

Therefore, there is a need for a hot tub cover that is strong enough to support a user standing on the cover while removing snow and ice from the cover. Such a needed invention would be fortified with a metal or other suitably rigid and durable frame, and would include various water-impermeable layers for preserving the insulating foam therein. Such a needed cover would further allow for some of the heat of the hot tub to be conducted through the cover to melt any snow or ice accumulated thereon. The present invention accomplishes these objectives.

SUMMARY OF THE INVENTION

The present device is a cover for a hot tub that has an open top end and at least one peripheral side wall. The cover comprises at least one deck that includes a rigid frame surrounded by a foam material. Preferably the cover includes two of the decks each pivotally and mutually fixed at hinge.

The frame and the foam material of each deck are covered on a top side and at side edges of each deck with a layer of plywood coated with an elastomeric paint that, preferably, includes high-friction grit for improved durability, strength and gripping. A bottom side of each deck is covered with a first water impervious web, such as a PVC coated fabric web, rigid vinyl panels, or another suitable water-impervious material. In one embodiment, the rigid frame is made with at least one galvanized steel channel. The foam material may be a polystyrene sheet, an expanded polyurethane foam, or the like.

The cover further comprises a skirt that is made from a second water impervious web and fixed proximate to at least one of the side edges of each deck. The skirt extends down to cover at least a portion of the at least one peripheral wall of the hot tub when the cover is fixed over the open top end of the hot tub. Preferably the skirt includes at least one locking strap adapted to cooperate with a locking receiver fixed with the at least one peripheral side wall of the hot tub.

In one embodiment, the foam material includes a plurality of foam beams each of which is mutually separated and includes a plurality of notches formed in a top surface thereof. As such, heat from the hot tub may traverse each deck 30 through openings between the foam beams and the notches to melt snow or ice formed on the top side of each deck.

The present invention is a hot tub cover that is strong enough to support a user standing on the cover while removing snow and ice therefrom. The present invention is fortified with a metal or other suitably rigid and durable frame, and includes various water-impermeable layers for preserving the insulating foam therein. In one embodiment, the present cover allows for some of the heat of the hot tub to be conducted through the cover to melt any snow or ice formed thereon. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
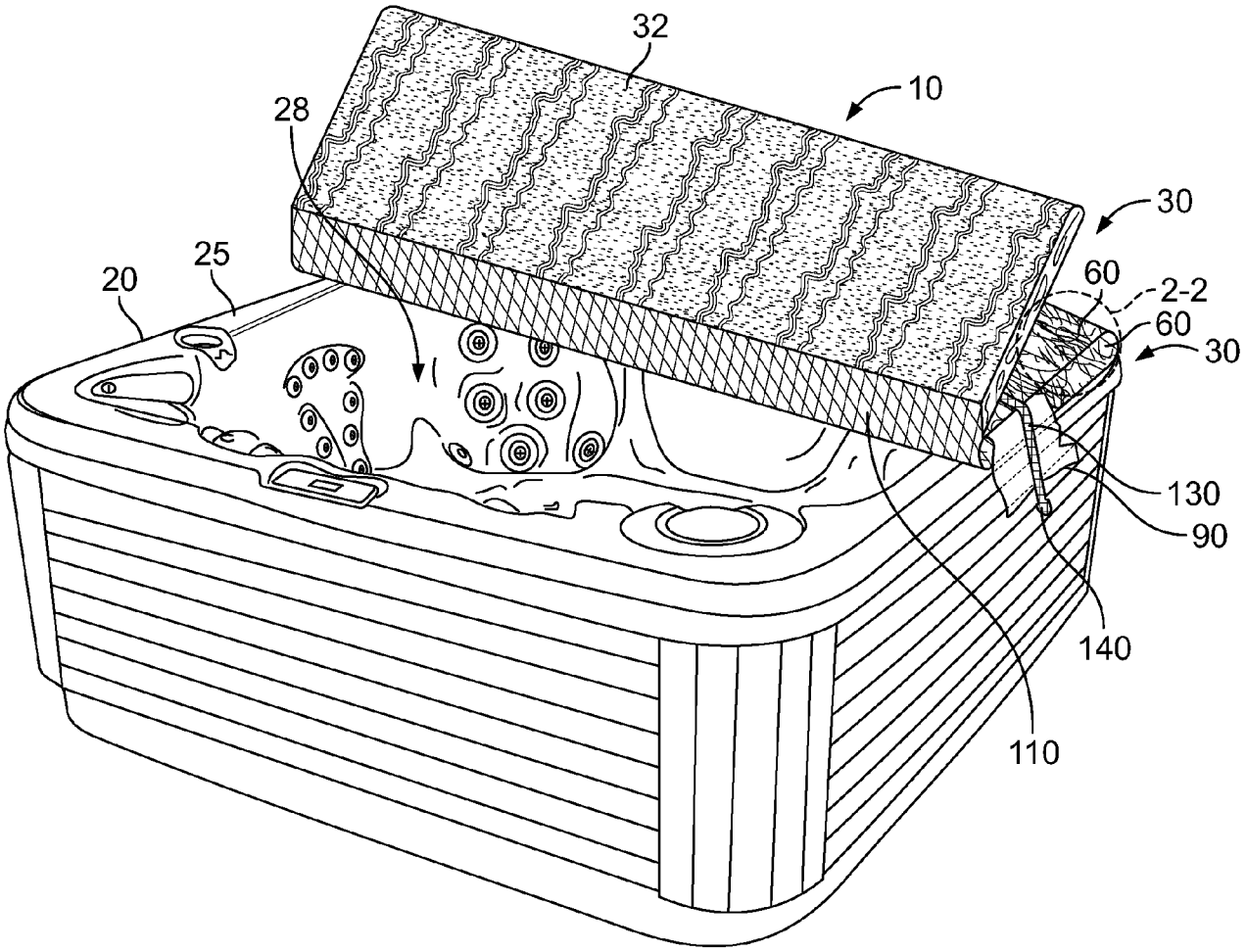
FIG. 1 is a perspective view of the invention.
Figure 2:
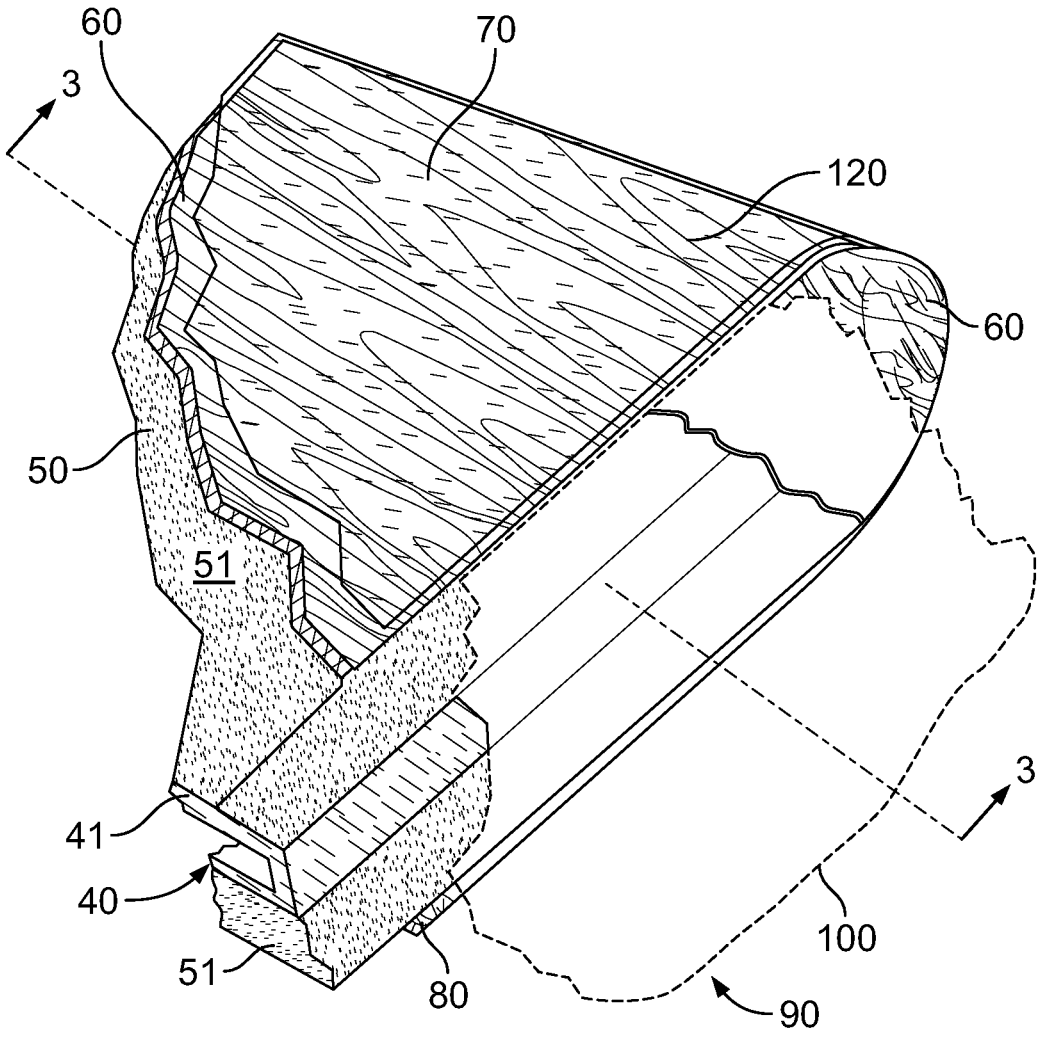
FIG. 2 is a partial perspective view, partially cut-away to reveal a rigid frame surround by a foam material and plywood.
Figure 3:
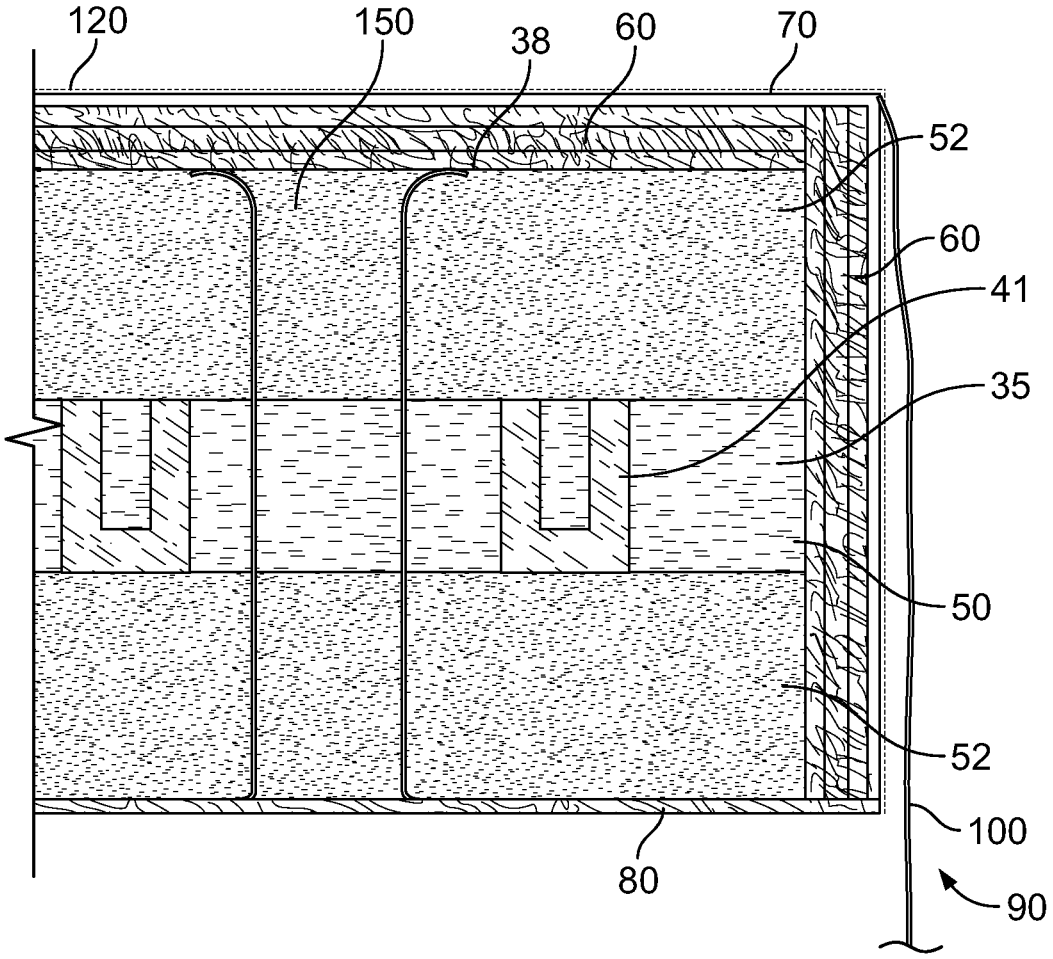
FIG. 3 is a cross-sectional view thereof, taken generally along lines 3-3 of FIG. 2.

FIGS. 1-3 illustrate a cover 10 for a hot tub 20 that has an open top end 28 and at least one peripheral side wall 25. The cover 10 comprises at least one deck 30 that includes a rigid frame 40 surrounded by an insulating foam material 50. Preferably the cover 10 includes two of the decks 30 each pivotally and mutually fixed at hinge 110, as illustrated in FIG. 1. Such a hinge 110 may be elastomeric or flexible and be incorporated into a flexible vinyl web or the like.

The frame 40 (FIG. 5) and the foam material 50 (FIGS. 3 and 4) of each deck 30 are covered on a top side 38 and at side edges 35 of each deck 30 with a water barrier 60, such as a layer of plywood coated with an elastomeric paint 70 that, preferably, includes high-friction grit 120 for improved durability and strength. Such an elastomeric paint 70 forms a water-impervious layer on the top side 38 of each deck 30. The water barrier 60 may also be comprised of a water-impervious vinyl fabric material, or the like. A bottom side 32 of each deck 30 is covered with a first water impervious web 80, such as a PVC coated fabric web, rigid vinyl panels, or another suitable water-impervious material.

In one embodiment, the rigid frame 40 is made with at least one galvanized steel channel 41, such as the U-shaped channel 41 illustrated in FIGS. 2 and 3. The foam material 50 may be a polystyrene sheet 51, expanded polyurethane foam 52, or the like. In one embodiment (FIGS. 4 and 5), the foam material 50 is separated by air in a lattice-type frame 40.

The cover 10 further comprises a skirt 90 that is made from a second water impervious web 100 and fixed proximate to at least one of the side edges 35 of each deck 30. The skirt 90 extends down to cover at least a portion of the at least one peripheral wall 25 of the hot tub 20 when the cover 10 is fixed over the open top end 28 of the hot tub 20. Preferably the skirt 90 includes at least one locking strap 130 adapted to cooperate with a locking receiver 140 fixed with the at least one peripheral side wall 25 of the hot tub 20. The second water impervious web 100 is preferably made from a PVC coated fabric web, a rigid vinyl panels, or the like. In one embodiment, the cover 10 includes at least one handle (not shown) for facilitating the carrying and transport of the cover 10.

Figure 6:
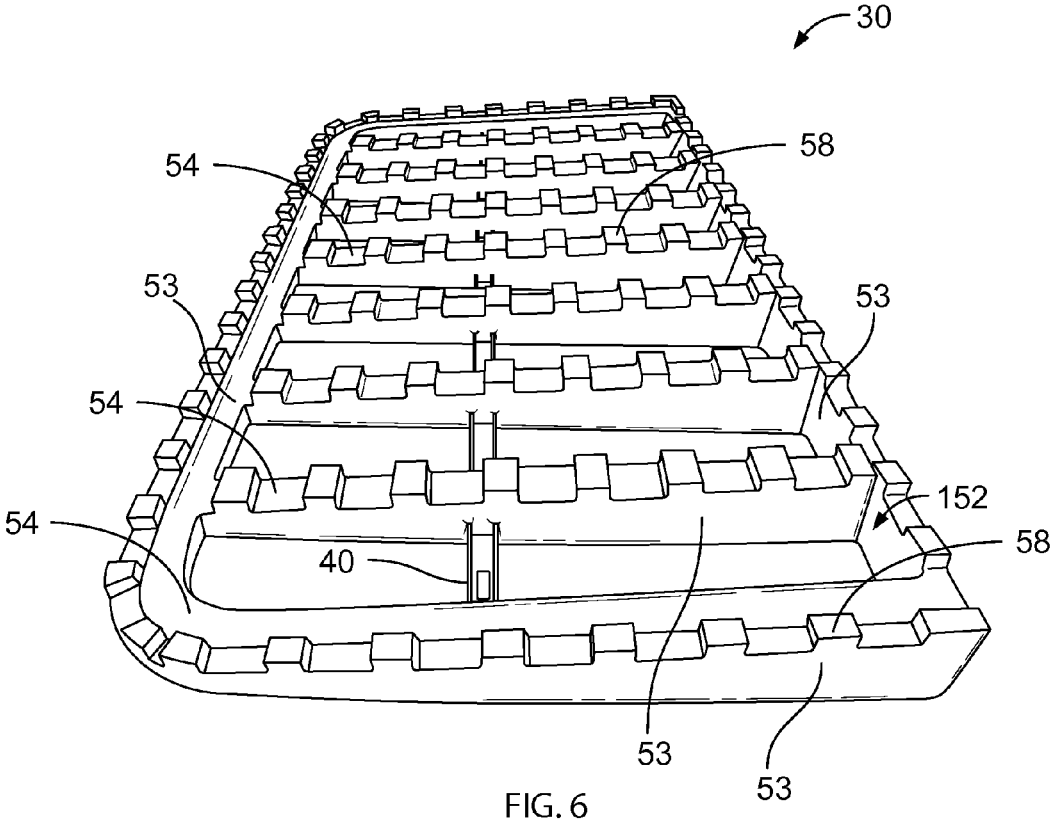
FIG. 6 is a partial perspective view of a preferred embodiment of one of the decks.

In one preferred embodiment, the foam material 50 includes a plurality of foam beams 53 (FIG. 6) each of which is mutually separated and includes a plurality of notches 54 formed in a top surface 58 thereof. As such, heat from the hot tub 20 may traverse each deck 30 through openings 152 between the foam beams 53 and the notches 54 to melt snow or ice formed on the top side 38 of each deck 30.

Figure 4:
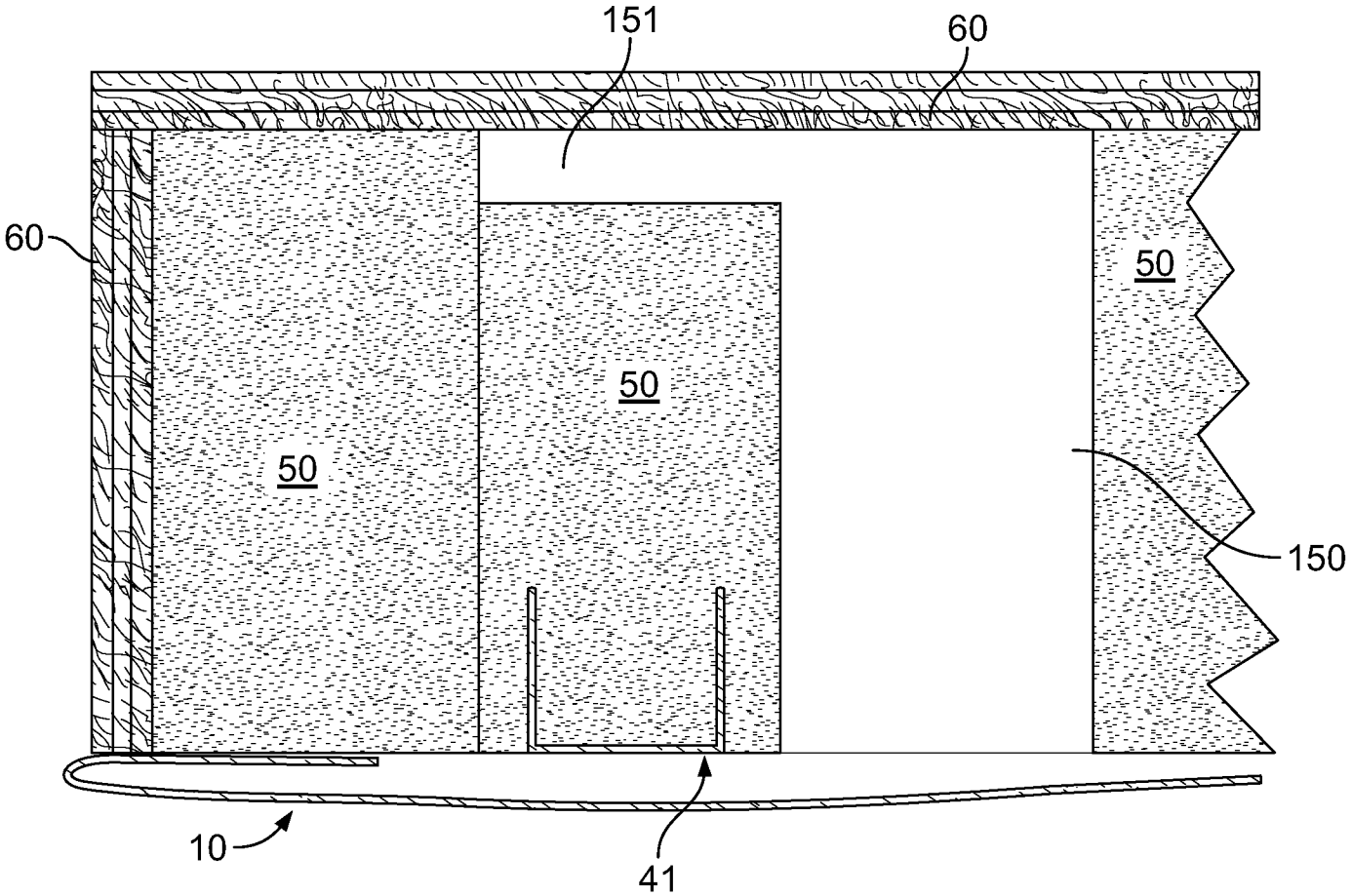
FIG. 4 is a partial cross-sectional view of an alternate embodiment of the invention.
Figure 5:
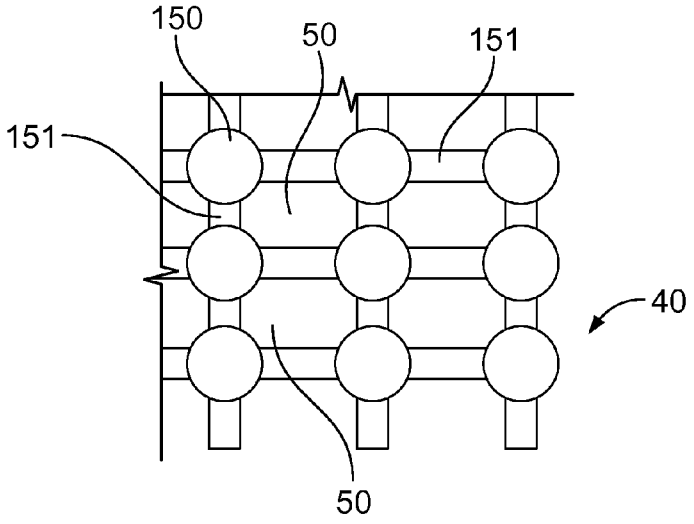
FIG. 5 is a top-plan diagram of the embodiment of FIG. 4 of the invention.

In another embodiment, a plurality of vertical channels 150 traverse each deck 30 through the foam material 50 thereof (FIGS. 3-5) from proximate the top side 38 of the deck 30 to proximate the bottom side 32 of the deck 30. In one embodiment, a plurality of lateral channels 151 may interconnect adjacent vertical channels 150 (FIGS. 4 and 5). As such, heat from the hot tub 20 may traverse each deck 30 through the plurality of channels 150,151 to melt snow or ice formed on the top side 38 of each deck 30.

While a particular form of the invention has been illustrated and described, it will be apparent that various modifications can be made without departing from the spirit and scope of the invention. For example, while square cover 10 with two rectangular decks 30 are illustrated, other shapes and configurations could be utilized as needed for any particular shape of hot tub 20. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A cover for a hot tub having an open top end and at least one peripheral side wall, the cover comprising:

at least one deck that includes a rigid frame surrounded by a foam material, the frame and foam material covered on a top side and side edges thereof with a water barrier, a bottom side of the deck covered with a first water impervious web, the foam material including a plurality of foam beams each mutually separated and including a plurality of notches formed in a top surface thereof; and a skirt made from a second water impervious web and fixed proximate to at least one of the side edges of the deck and extending down to cover at least a portion of the at least one peripheral wall of the hot tub when the cover is fixed over the open top end of the hot tub;

whereby with the deck laying over the top end of the hot tub and the skirt extending down to cover at least a portion of the at least one peripheral wall of the hot tub, heat from the hot tub radiates through spaces between the foam beams and notches to heat the top side of the hot tub to melt any snow or ice on the cover.

2. The cover of claim 1 wherein the cover includes two of the decks, each deck pivotally mutually fixed at an elastomeric hinge.

3. The cover of claim 1 wherein the rigid frame is made with at least one galvanized steel channel.

4. The cover of claim 1 wherein the water barrier is a layer of plywood, the plywood coated with an elastomeric paint.

5. The cover of claim 4 wherein the elastomeric paint covering the plywood top side and side edges of each deck includes high-friction grit.

6. The cover of claim 1 wherein the water barrier comprises a vinyl fabric.

7. The cover of claim 1 wherein the first and second water impervious webs are PVC coated fabric webs.

8. The cover of claim 1 wherein the first and second water impervious webs are rigid vinyl panels.

9. The cover of claim 1 wherein the skirt includes at least one locking strap adapted to cooperate with a locking receiver fixed with the at least one peripheral side wall of the hot tub.

* * * * *